US005967380A

United States Patent [19]

Litvin

[11] Patent Number: 5,967,380

[45] Date of Patent: Oct. 19, 1999

[54] LIQUID RESERVOIR TANK

[75] Inventor: Charles Litvin, West Chester, Pa.

[73] Assignee: Lasko Holdings, Inc., West Chester, Pa.

[21] Appl. No.: 09/092,506

[22] Filed: Jun. 5, 1998

[51] Int. Cl.[6] ..... B67D 5/00

[52] U.S. Cl. ..... 222/185.1; 222/469; 222/509; 222/518; 141/352; 141/364; 261/72.1

[58] Field of Search ..... 222/185.1, 469, 222/509, 518; 141/346, 351–357, 363, 364, 375; 261/72.1

[56] References Cited

U.S. PATENT DOCUMENTS 5,379,813 1/1995 Ing ..... 141/351
5,706,985 1/1998 Feer ..... 222/185.1
5,743,106 4/1998 Lee ..... 222/509
5,857,596 1/1999 Lee ..... 222/509

*Primary Examiner*—J. Casimer Jacyna
*Attorney, Agent, or Firm*—Zachary T. Wobensmith, III

[57] ABSTRACT

A reservoir tank for use with an apparatus to provide liquid thereto, which includes a cylindrical tank open at one end with an end cap removably engaged therewith, which has a spring urged arm with a stem and stopper which normally closes off an opening in the cap, the arm is depressed to allow liquid to enter the tank for filling, and the arm is engaged by an upstanding pin from the apparatus when the tank is inverted and placed in the liquid receiving portion to allow liquid to flow out to fill the apparatus.

4 Claims, 3 Drawing Sheets

LIQUID RESERVOIR TANK

BACKGROUND OF THE INVENTION

1. Field of the Invention

This invention relates to a reservoir tank assembly for an apparatus, of the type which has an end cap, which can be removed for cleaning and which has a spring loaded arm, which is manually depressed for filling, and which arm is also depressed when the tank is inverted and in place in a apparatus by an upstanding pin from the apparatus liquid receiving portion, to supply liquid to the apparatus.

2. Description of the Prior Art

It is well known in the reservoir tank art to use a spring urged stem connected to a stopper, which closes off an opening in a reservoir tank, and which permits liquid which may be water, kerosene or other liquid to flow thereout when the tank is inverted, and the stem is contacted by an upstanding pin from a fluid receiving portion of an apparatus, which moves the stopper to allow liquid to flow into the fluid receiving portion.

The prior art structures are difficult to clean as they do not provide complete access to the tank.

Various structures which use similar construction are shown in the U.S. patents to Crockett No. 2,685,978; Kappler No. 3,123,107; Mulgrive No. 3,201,012; Sawyer, III No. 5,131,170; Weber No. 5,154,212; Baker, et al., No. 5,222,531, and Feer No. 5,706,985, but none of them has provisions for filling the tank without removing a cap.

None of the prior art structures provides an end cap which is removable for cleaning the tank, with an arm carried by the end cap, which has a spring urged stem with a stopper closing off an opening into the tank, which arm is depressed by the user to permit filling of the reservoir tank, and which when the tank is inverted and in place in an apparatus, the arm is depressed by an upstanding pin to unseat the stopper to allow water flow out the tank opening into the apparatus.

SUMMARY OF THE INVENTION

It has now been found that a reservoir tank assembly for apparatus has been provided which has a removable end cap, with an arm which is manually depressed to move a stopper off an opening for filling the tank, and which when the tank is inverted the arm is depressed by an upstanding pin in the apparatus to allow water to flow thereout into the fluid receiving portion of the apparatus.

The principal object of the invention is to provide a reservoir tank assembly for an apparatus which has an end cap with an arm that is manually depressed for filling the tank.

A further object of the invention is to provide a reservoir tank assembly for an apparatus where the arm is depressed to allow liquid to flow out into the liquid receiving portion of the apparatus.

A further object of the invention is to provide a reservoir tank assembly with an end cap that is removable for complete access to the tank.

A further object of the invention is to provide a reservoir tank assembly that is simple and inexpensive to construct but is reliable and easy to use.

A further object of the invention is to provide a reservoir tank assembly that is of molded plastic.

A further object of the invention is to provide a reservoir tank assembly that is useful with a variety of devices.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof in which.

It should, of course, be understood that the description and drawings herein are merely illustrative and that various modifications and changes can be made in the structure disclosed without departing from the spirit of the invention.

Like numerals refer to like parts throughout the several views.

DESCRIPTION OF THE PREFERRED EMBODIMENT

When referring to the preferred embodiment, certain terminology will be utilized for the sake of clarity. Use of such terminology is intended to encompass not only the described embodiment, but also technical equivalents which operate and function in substantially the same way to bring about the same result.

Figure 1:
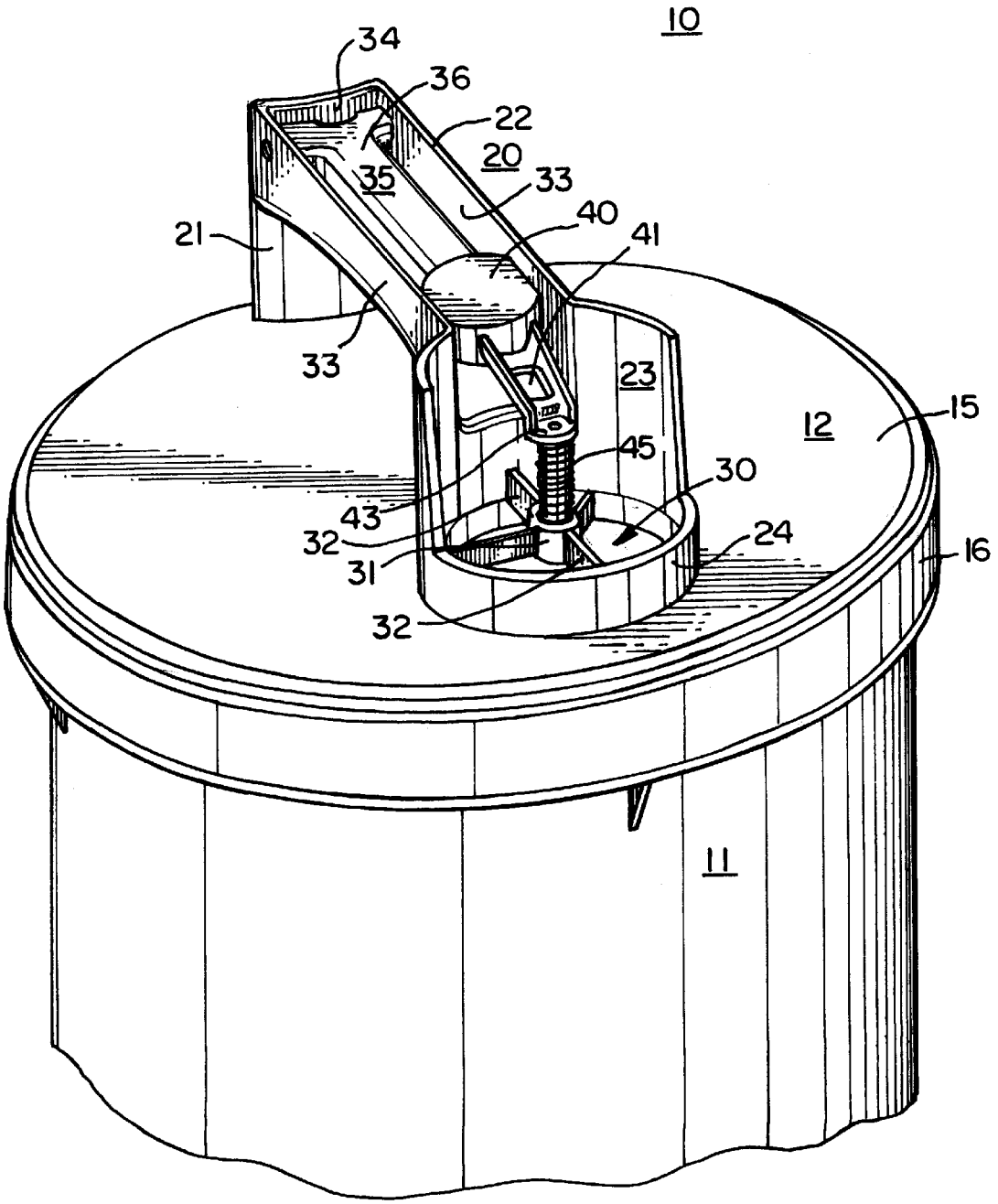
FIG. 1 is a view in perspective of the reservoir tank assembly of the invention.
Figure 2:
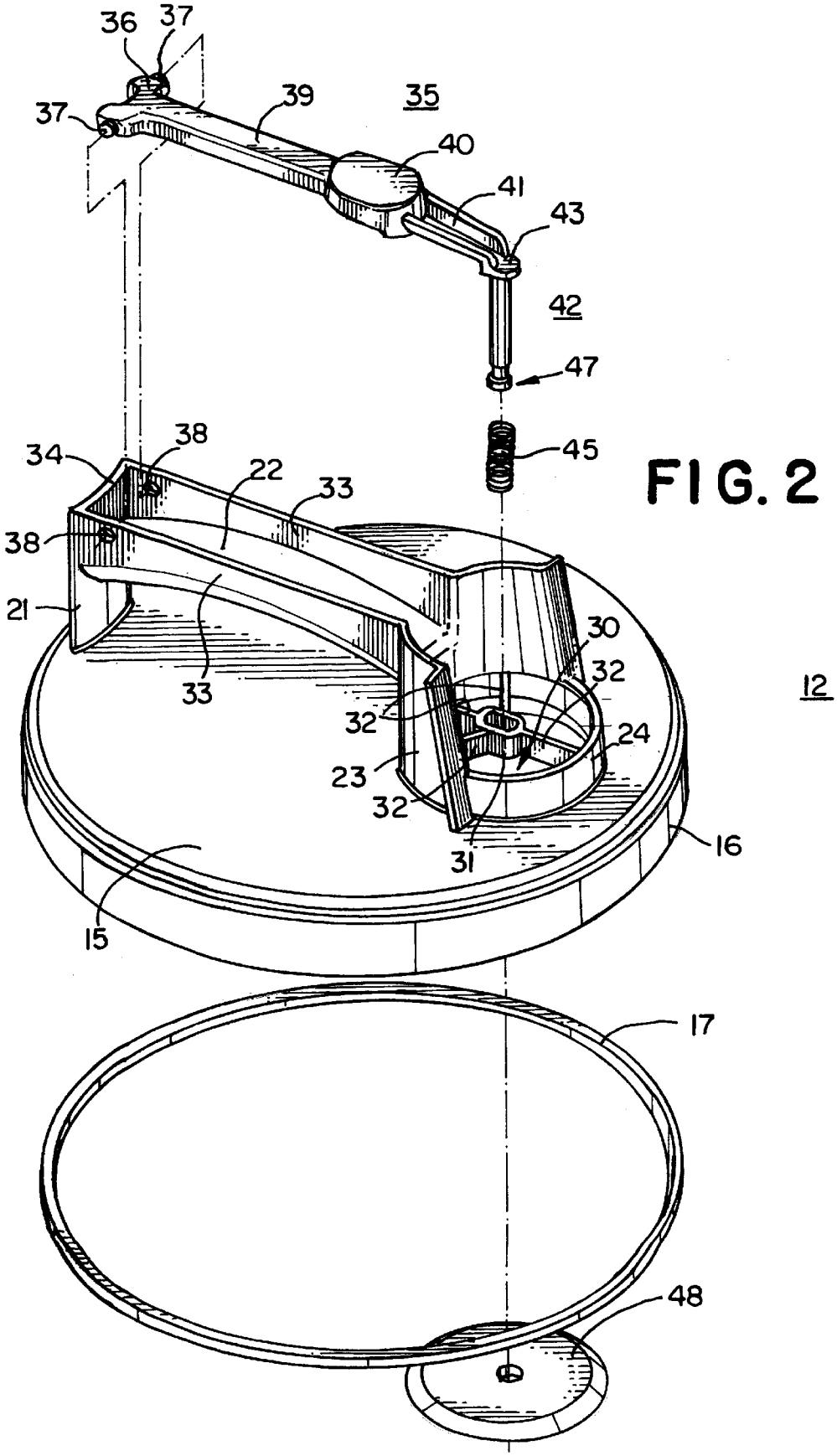
FIG. 2 is an exploded perspective view of the end cap portion of the reservoir tank of FIG. 1.
Figure 3:
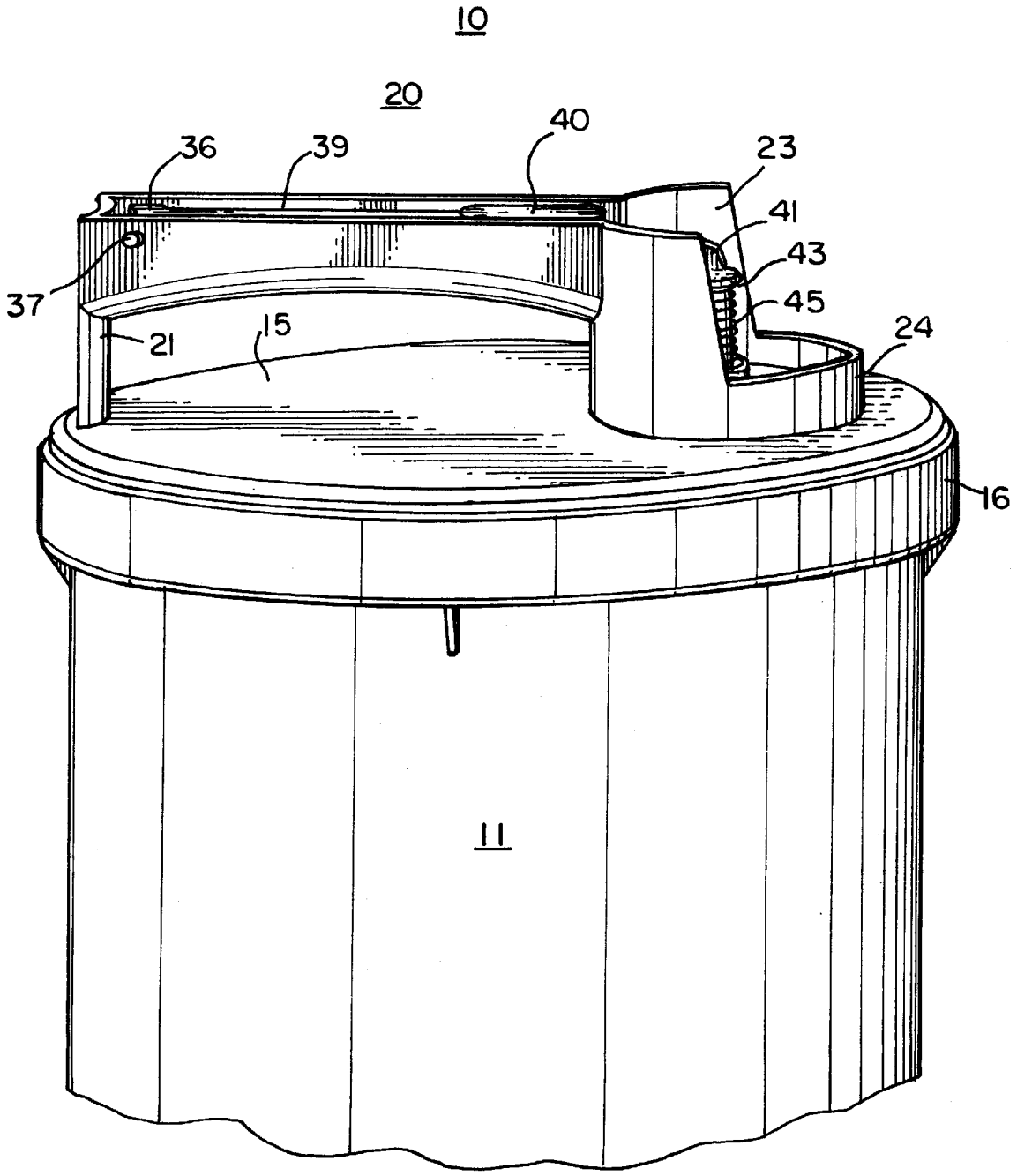
FIG. 3 is a side elevational view of the reservoir tank assembly of the invention.

Referring now more particularly to FIGS. 1–3 of the drawings, the reservoir tank assembly 10 is therein illustrated, which includes a cylindrical tank 11 open at one end, which may be constructed of any suitable material with molded polystyrene plastic being particularly suitable.

The tank 11 is closed off at its open end by an end cap 12, which is also preferably constructed of molded plastic such as polystyrene. The end cap 12 is of circular configuration with a top wall 15, which has a ring 16 perpendicular thereto, which extends around the end of the tank 11.

The cap 12 may be attached to the tank 11 by threads (not shown) internal to the cap and external to the tank 11, with a washer 17 therebetween for sealing.

The top wall 15 has an upstanding handle 20 integral therewith, which includes an end wall 21 extending upwardly from wall 15, with a U-shaped member 22 extending therefrom across the wall 15 until it terminates in an upstanding half cylindrical open tube 23, which is also integral with top wall 15.

The tube 23 includes a front wall 24 which completes it and which is of lesser height than the tube 23.

An opening 30 is provided in top wall 15, communicating with tube 23, which opening 30 has a valve stem guide 31 therein, which is centrally located in opening 30, and attached to the wall 15 by a plurality of arms 32.

The member 22 has side walls 33 and an end wall 34 which is a continuation of end wall 21.

An arm 35 is provided which has a fork 36 with bearings 37 on each side, which are engaged in openings 38 in side walls 33 of member 22. The arm 35 has a rib 39 connected to fork 36 with an oval pad 40 connected to the rib 39, and an extension 41 connected to the pad 40.

The extension 41 has a valve stem 42 extending perpendicularly from extension 41, with a disc 43 thereon, which is contacted by one end of a spring 45 which is on stem 42.

The spring 45 at the end opposite to disc 43 engages a shoulder (not shown) in valve stem guide 31 urging arm 35 upwardly. The stem 42 has a cutout 47 with a stopper 48 engaged therewith which is of circular configuration. The stopper 48 is normally urged upwardly against the bottom of top wall 15 to close off opening 30 to retain liquid in reservoir tank 11.

The mode of operation will now be described.

With the reservoir tank assembly 10 assembled as shown in FIGS. 1 and 3, the user grasps handle 20 and transports it to a source of liquid, such as water (not shown).

The opening 30 is placed under the liquid source (not shown) and the arm 35 is depressed against the force of the spring 45 to compress it and to disengage stopper 48 from the bottom of wall 15 (not shown) and allow liquid to pass through opening 30 into tank 11 until it is filled, whereupon the arm 35 is released to cause stopper 48 to close off opening 30. The tank assembly 10 is transported to the apparatus with which it is to be used such as a humidifier (not shown) whereupon it is inverted and placed in the water receiving portion (not shown), which has an upstanding pin (not shown), which engages pad 40 and moves the arm 35 to compress spring 45 and move stopper 48 so that water can flow out opening 30 into the humidifier.

If it is desired to clean the interior of tank 11 the cap 12 can be removed by rotating it to disengage the threads (not shown) from the threads (not shown) on the tank 11.

The operation can continue as desired.

It will thus be seen that a reservoir tank assembly has been provided with which the objects of the invention are achieved.

I claim:

1. A reservoir tank assembly to provide liquid to an apparatus, which apparatus has a liquid receiving portion with an upstanding pin to engage said assembly, the improvement which comprises said reservoir tank assembly includes a reservoir tank which is of circular configuration and open at one end, an end cap engaged with said tank and closing off its open end, said end cap has a top wall with upstanding handle means, said handle means includes a tube, and an arm having means for engaging said pin, an opening in said top wall of said end cap in communication with said tube, a valve stem guide in said opening, a valve stem extending from said arm and through said guide, a spring carried on said valve stem, a disc on said valve stem in contact with one end of said spring, a shoulder in said guide in contact with the other end of said spring, and a stopper on said valve stem below said guide and urged by said spring into contact with said end cap top wall to close off said opening.

2. A reservoir tank assembly as defined in claim 1 in which said reservoir tank is of molded plastic.

3. A reservoir tank assembly as defined in claim 1 in which said end cap is of molded plastic.

4. A reservoir tank assembly as defined in claim 1 in which said end cap is threadably engaged with said tank for removal for access thereto.

* * * * *